US007770971B2

(12) United States Patent
Bellows et al.

(10) Patent No.: US 7,770,971 B2
(45) Date of Patent: Aug. 10, 2010

(54) SEAT SUPPORT STRUCTURE FOR A CHILD MOTION DEVICE

(75) Inventors: William B. Bellows, Wyomissing, PA (US); Samuel Chambers, Conshohocken, PA (US); Baku Kakuda, Reading, PA (US)

(73) Assignee: Graco Children's Products Inc., Atlanta, GA (US)

( * ) Notice: Subject to any disclaimer, the term of this patent is extended or adjusted under 35 U.S.C. 154(b) by 189 days.

(21) Appl. No.: 12/055,899

(22) Filed: Mar. 26, 2008

(65) Prior Publication Data

US 2008/0238163 A1 Oct. 2, 2008

Related U.S. Application Data

(63) Continuation-in-part of application No. 11/385,260, filed on Mar. 20, 2006, now Pat. No. 7,563,170.

(60) Provisional application No. 60/908,174, filed on Mar. 26, 2007, provisional application No. 60/732,640, filed on Nov. 3, 2005.

(51) Int. Cl.
*A47D 1/10* (2006.01)
*A47D 13/10* (2006.01)

(52) U.S. Cl. ..... 297/256.16; 297/256.1; 297/273; 297/452.39

(58) Field of Classification Search ..... 297/256.16, 297/260.1, 259.3, 273; 472/29, 33, 119
See application file for complete search history.

(56) References Cited

U.S. PATENT DOCUMENTS 1,432,746 A * 10/1922 Downey ..... 472/4
2,704,111 A * 3/1955 Wunderlich ..... 297/274
3,147,972 A * 9/1964 Borsuk ..... 472/29
4,805,902 A * 2/1989 Casagrande ..... 472/119

(Continued)

FOREIGN PATENT DOCUMENTS

JP 48 68367 9/1973

(Continued)

OTHER PUBLICATIONS

Search Report issued in corresponding European Patent Application No. 08153335.8 mailed Aug. 12, 2008.

(Continued)

*Primary Examiner*—Sarah B McPartlin
(74) *Attorney, Agent, or Firm*—Lempia Braidwood LLC

(57) ABSTRACT

A child motion device has a frame assembly configured to rest on a floor surface, a drive system defining a generally vertical axis of rotation, and a support arm supported above the floor surface by the frame assembly. The support arm is cantilevered from near the axis of rotation and has a driven end coupled to the drive system, which pivotally reciprocates the support arm through a partial orbit around the axis of rotation. A seat holder is carried by the support arm spaced from the driven end and a seat is supported by the seat holder. The seat and seat holder are constructed to permit the seat to be removed from the seat holder. The seat is usable as a seat when removed from the seat holder and can be positioned on the seat holder in more than one optional seat facing orientation.

28 Claims, 13 Drawing Sheets

U.S. PATENT DOCUMENTS

| | | | | |
|---|---|---|---|---|
| 5,547,425 | A * | 8/1996 | Krhs et al. | 472/110 |
| 5,562,548 | A * | 10/1996 | Pinch et al. | 472/119 |
| 6,027,409 | A * | 2/2000 | Favorito et al. | 472/118 |
| 7,258,617 | B2 * | 8/2007 | Chen | 472/118 |
| 7,445,559 | B2 * | 11/2008 | Kakuda | 472/118 |
| 2005/0127727 | A1 | 6/2005 | Gangadharan et al. | |
| 2006/0220427 | A1 | 10/2006 | Patrizi et al. | |

FOREIGN PATENT DOCUMENTS

| | | |
|---|---|---|
| WO | WO 2007/056655 | 5/2007 |

OTHER PUBLICATIONS

English language translation of JP 48 68367.

Graco Children's Products Inc. Infant Restraint/Carrier Owner's Manual (2007).

Graco Children's Products Inc. SnugRider Owner's Manual (2006).

Graco Children's Products Inc. Safe Seat Infant Restraint/Carrier Owner's Manual (2005).

* cited by examiner

SEAT SUPPORT STRUCTURE FOR A CHILD MOTION DEVICE

RELATED APPLICATION DATA

This patent is related to and claims priority benefit of U.S. provisional patent application Ser. No. 60/908,174 filed on Mar. 26, 2007 and is a continuation-in-part of U.S. patent application Ser. No. 11/385,260 filed on Mar. 20, 2006, which claimed priority benefit of U.S. provisional patent application Ser. No. 60/732,640 filed on Nov. 3, 2005.

BACKGROUND OF THE INVENTION

1. Field of the Disclosure

The present disclosure is generally directed to child motion and soothing devices, and more particularly to a support structure for coupling and supporting a seat to such a device.

2. Description of Related Art

Child motion devices such as conventional pendulum swings and bouncers are known in the art. These types of devices are often used to entertain and, sometimes more importantly, to sooth or calm children, and particularly infants. A child is typically placed in a seat of the device and then the device is used to swing the child in a reciprocating pendulum motion or bounce the child in a generally vertical motion. Standard pendulum swings often include a seat suspended by an A-frame support stand. In operation, the seat swings forward and backward between the sides of the A-frame in the pendulum motion.

Most types of child motion devices do not typically enable multiple different optional seating positions and arrangements for the child or permit optional motion characteristics. A typical child motion device has only a single seating orientation and a single motion characteristic that can be provided for a child placed in the seat. A number of these types of devices are motorized to impart automatic and continuous movement to the child seat. These devices typically mount the motor above the head of a child within the device. The motor can be a noisy nuisance for the child as it is positioned near their head. Additionally, the drive takes up space above the seat, which can make it difficult for an adult to position a child in the device.

Some swing products are configured with a support that can accept an infant car seat carrier. For example, the Snug-Glider® swing commercially available from Graco Children's Products Inc., the assignee of the present disclosure, has a frame to which an infant car seat carrier may be coupled to serve as the swing seat. The seat frame of the swing is connected to A-frame supports and enables the above-described pendulum motion.

Other manufacturers have produced child motion devices with seats that can be moved between two different seat facing orientations and/or that can be removed and utilized as a car seat or an infant carrier. For example, Fisher-Price manufactures a pendulum swing with a motor above the child's head. The seat of the swing can be oriented in one of two optional seat facing directions by rotating the suspended pendulum-type swing arm through a 90 degree angle.

U.S. Pat. No. 4,805,902 discloses a complex apparatus in a pendulum-type swing. The seat moves in a manner such that a component of its travel path includes a side-to-side arcuate path in a somewhat horizontal plane (see FIG. 9 of the patent). The seat can be rotated between two different seat facing directions on the seat support.

U.S. Pat. No. 6,343,994 discloses another child swing wherein the base is formed having a first stationary part and a second part that can be turned or rotated by a parent within the first part. The seat swings in a conventional pendulum-like manner and a parent can rotate the device within the stationary base part to change the view of the child seated in the seat.

U.S. Pat. No. 5,562,548 discloses a pendulum type swing with a seat support and a removable seat. This patent discloses that the seat can be configured to attach to and detach from the support and can be configured to be used as an infant carrier or car seat when not attached to the swing. The '548 patent also teaches that the support can have a base that can pivot or rotate about a vertical axis between a forward facing seat position and a side facing seat position. The seat can thus be supported by the swing and swing with a child facing forward or sideways.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Figure 1:
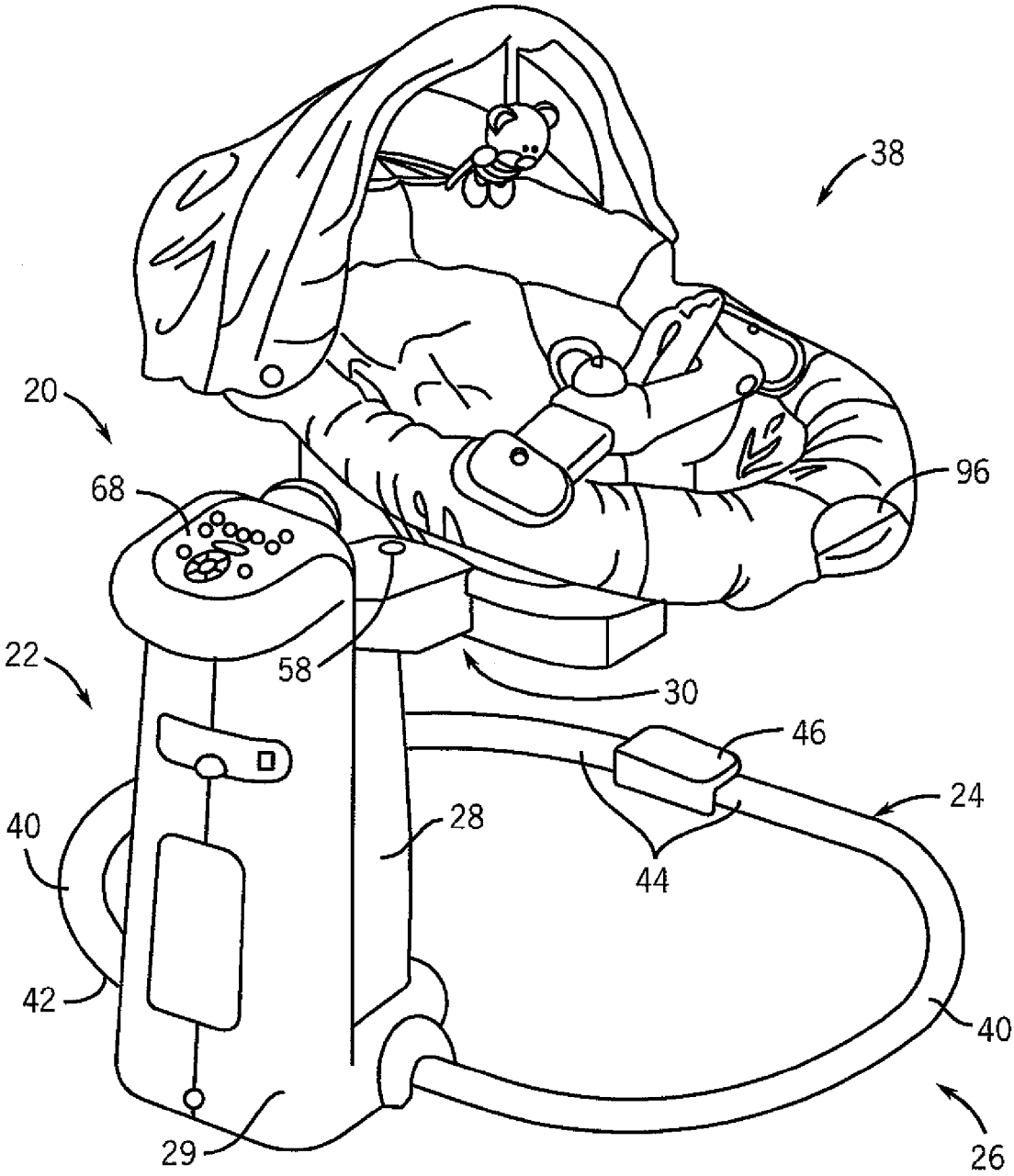
FIG. 1 shows a rear perspective view of a child motion device constructed in accordance with the teachings of the present invention.

Research has shown that many infants and children are not adequately soothed or calmed by use of currently known motion devices, such as vertical bounce motion or a pendulum swinging motion. Research has also shown that these same children may be more readily calmed or soothed by motion imparted by a parent or adult holding the child. Parents often hold their children in their arms and in front of their torso and move in a manner that is calming and/or soothing to the child. Such movements can include side-to-side rocking, light bouncing up and down, or light rotational swinging as the parent either swings their arms back and forth, rotates their torso from side-to-side, or moves in a manner combining these motions. Whether this soothing effect results from the child being in close contact with the caregiver or from the motion characteristics imparted by the caregiver has not before been clearly determined.

A child motion device is disclosed herein that more effectively soothes, calms, and/or entertains infants and children. The disclosed child motion device solves or improves upon one or more of the problems or difficulties noted above with respect to known motion devices. The disclosed alternative motion device has a frame assembly that employs a generally horizontally supported, oscillating arm. In one example, a child seat or other child carrying or supporting device can be coupled to and carried by the support arm and can be moved through an orbit segment or travel arc that lies in a plane that can be parallel to a reference plane defined by a floor surface or tilted or angled slightly relative to the reference plane. In the disclosed example, the support arm has a driven end coupled to a drive system that reciprocally moves the support arm through its travel path.

In one example, the distal or free end of the support arm is configured to accept and support the child seat or other device above the ground surface. In one example, the support arm can include a child seat holder that permits setting the child seat on the alternative motion device in more than one optional seat orientation. In this way, a child seated in the seat can experience a variety of different motions. In another example, the seat holder can be specifically configured to accept and support a seat or other child carrying device from another product, such as a car seat or an infant carrier. Thus, the seat support structure can be configured to be compatible with car seats and other carriers and can impart motion to the child occupant that has more complex motion characteristics than a simple pendulum motion. To this end, the seat support structure can be configured to accept a car seat carrier, an infant carrier, and/or a seat specifically designed for use with the disclosed child motion device. Compatibility with a car seat or infant carrier may be useful when a child falls asleep while in the car seat or carrier but prior to the seat being coupled to the child motion device. The child motion device disclosed herein thus can accommodate moving the child from a car, stroller, floor, or the like to the child motion device with minimal risk of waking the sleeping child.

In accordance with another aspect of the disclosure, a child motion device has a support structure to engage a car seat, infant carrier, or other seat in a manner that is secure while imparting motion to the child. For example, the child motion device may include a drive mechanism to move the seated child from side to side in a non-simple pendulum path. The seat can be secured to the child motion device. In accordance with another aspect of the disclosure, the seat can be coupled to the child motion device in a selected one of multiple optional seat facing orientations.

The terms generally, substantially, and the like as applied herein with respect to vertical or horizontal orientations of the various product components are intended to mean that the components have a primarily vertical or horizontal orientation, but need not be precisely vertical or horizontal in orientation. The components can be angled to vertical or horizontal, but not to a degree where they are more than 45 degrees away from the reference mentioned. In many instances, the terms "generally" and "substantially" are intended to permit some permissible offset, or even to imply some intended offset, from the reference to which these types of modifiers are herein applied.

Figure 2:
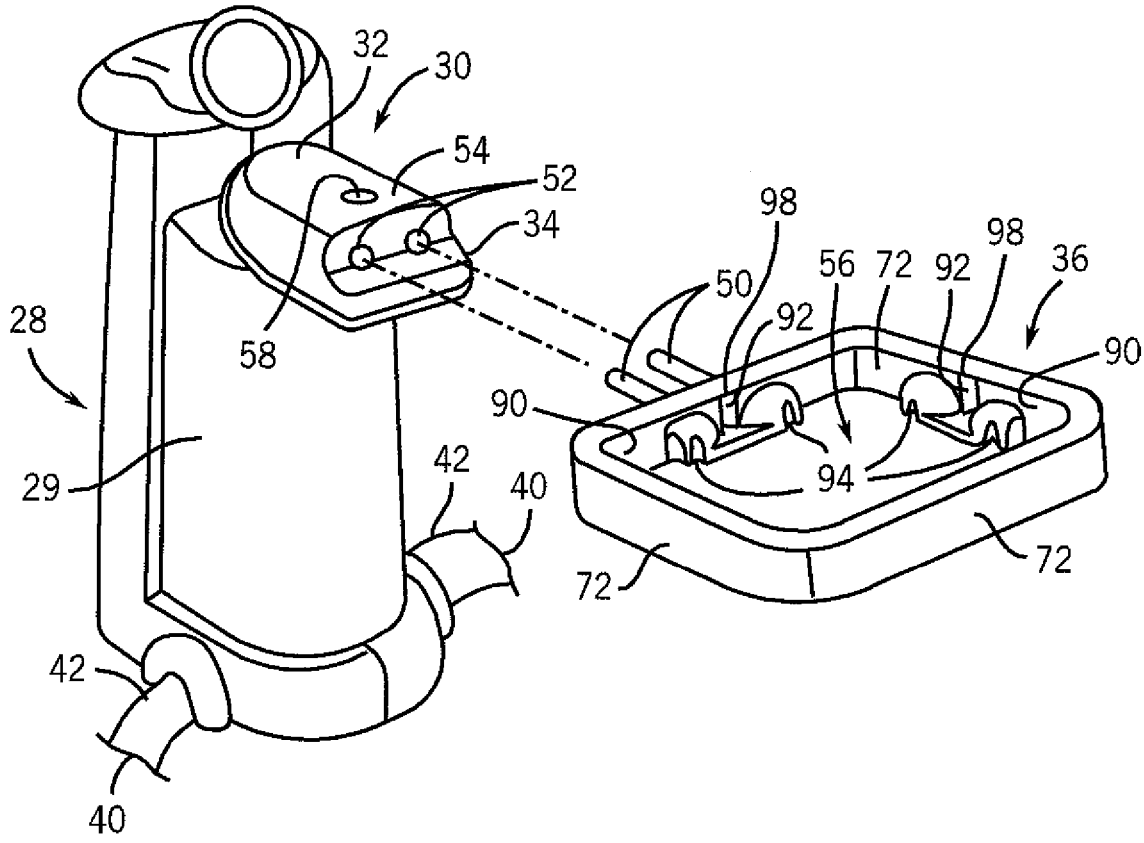
FIG. 2 shows a partially exploded view of the child motion device in FIG. 1 but with the child seat removed and not shown.

Turning now to the drawings, FIGS. 1 and 2 show one example of a child motion device 20 constructed in accordance with the teachings of the present invention. The device 20 in this example generally includes a frame assembly 22 that has a base section 24 configured to rest on a floor surface 26. Throughout this detail description, the term "floor surface" is utilized to define both a surface on which the device rests when in the in-use configurations and the orientation of a horizontal reference plane H for comparison to other aspects and parts of the invention for ease of description. However, the invention is not intended to be limited to use with only a specifically horizontal orientation of either the base section 24 of the frame assembly 22 or the reference surface or plane H. Instead, the floor surface 26 and the reference plane H are utilized to assist in describing relationships between the various components of the device 20.

The child motion device 20 shown in FIGS. 1 and 2 also has an upright riser, post, or spine 28 that extends upward from a part of the base section 24. In this example, the spine 28 is oriented in a generally vertical orientation relative to its longitudinal length. The spine disclosed herein can have a housing or cover 29 configured in any desired or suitable manner. The housing 29 can be ornamental, functional, or both. The housing 29 can also be removable to access the inner workings of the device if and when needed. The spine 28 can vary considerably in orientation, shape, size, configuration, and the like from the example disclosed herein.

In this example, a support arm 30 depicted in FIG. 2 is cantilevered from the spine 28 and extends generally outward in a radial direction from the spine. In this example, the support arm 30 has a driven end 32 that is connected to a portion of the spine 28. The support arm 30 is mounted for pivoting, lateral, side-to-side movement about its driven end through a travel path that is substantially or generally horizontal. As described below, the support arm 30 can travel through a partial orbit or arc segment of a predetermined angle and can rotate or reciprocate about an axis of rotation R. The rotation axis R can be offset from a vertical reference V and can be offset from an axis of the spine 28. Alternatively, the axis of rotation R can be aligned with the vertical reference V, the axis of the spine, or both if desired. As described below, the driven end 32 is driven by a drive system designed to reciprocate or oscillate the support arm. The support arm 30 in this example also has a distal or free end 34 that terminates at a seat holder 36. The seat holder 36 is configured to support a child seat 38 for movement with the support arm 30.

The various components of the child motion device 20 shown in FIG. 1 and described herein can vary considerably and yet fall within the spirit and scope of the present invention. Only one example is disclosed herein to illustrate the nature and function of the child motion device and its overall component configuration. In the example of FIG. 1, the base section 24 is positioned generally beneath the seat holder 36 in order to offset the load or moment that would be applied to the spine 28 by the weight of a child placed in the seat 38. The disclosed base section 24 of the frame assembly 22 in this example is a circular or oval hoop that is sized to provide a stable base for the device 20 when in use. The hoop in this example has two separate sections 40, each with one end 42 coupled to the bottom end of the housing 29 or spine 28. Each hoop section 40 has an opposite end 44 coupled to the end 44 on the other hoop section at a connector 46. Though not shown or described in detail herein, the ends 42 of the hoop sections 40, and thus the base section 24, can be removable from the spine 28 and/or foldable or pivotable to a position generally parallel to the spine 28. The sections 40 can also either be separable from one another at their respective connector ends 44 or be pivotable at the connector 46 to fold relative to one another. This would permit a more compact storage configuration of the device 20 when not in use.

Similarly, at least part of the support arm 30 as shown in FIG. 2 can be separable from the spine 28 at the driven end 32. In this example, a pair of elongate connector prongs 50 extends from the support arm nearer the driven end 32 of the arm 30. A pair of receptacles or openings 52 can be provided in a driven part 54 of the support arm 30 carried on the housing 29 or spine 28. The prongs 50 can be configured with grooves, ribs, oversized tips, or other detent mechanisms, though not shown. The receptacles 52 can likewise have complimentary spring biased detent mechanisms, also not shown, that resiliently and releasably engage the mechanisms on the prongs 50. The prongs 50 can thus be configured to snap into and out of the receptacles 52 to attach or detach the support arm 30. The detachability of all or part of the support arm 30 permits a still more compact storage configuration for the device 20. As shown in FIGS. 1 and 2, a release button 58 can be provided on the driven part 54 of the support arm 30 or another part of the device 20 to assist in releasing and detaching the support arm 30 when desired.

The structure and configuration of the seat holder 36 can vary considerably and yet fall within the spirit and scope of the present invention. In this example, the seat holder 36 is a square or rectangular ring surrounding a center opening 56. Other configurations and constructions of the seat holder 36 are also possible, and one example is described in greater detail below. In this example, the spine 28 includes the external housing 29 that can be configured to provide a pleasing or desired aesthetic appearance. The housing 29 can also act as a protective cover for the internal components, such as the drive system, of the device 20.

Figure 4:
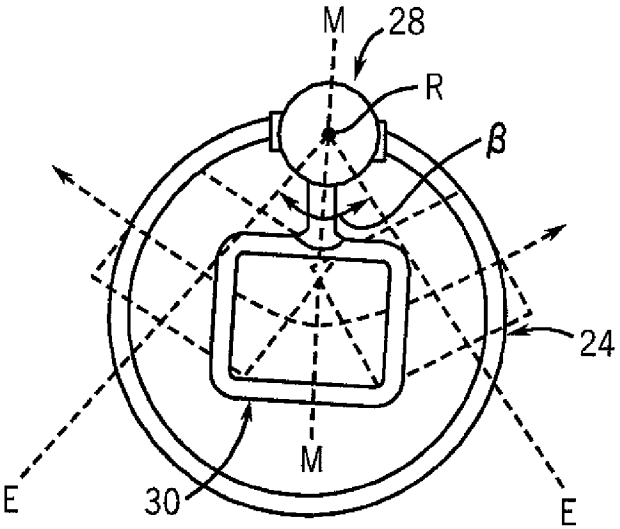
FIG. 4 is a schematic top view representing the child motion device in FIG. 1 and shows one example of the swing arm motion for the child motion device.
Figure 5:
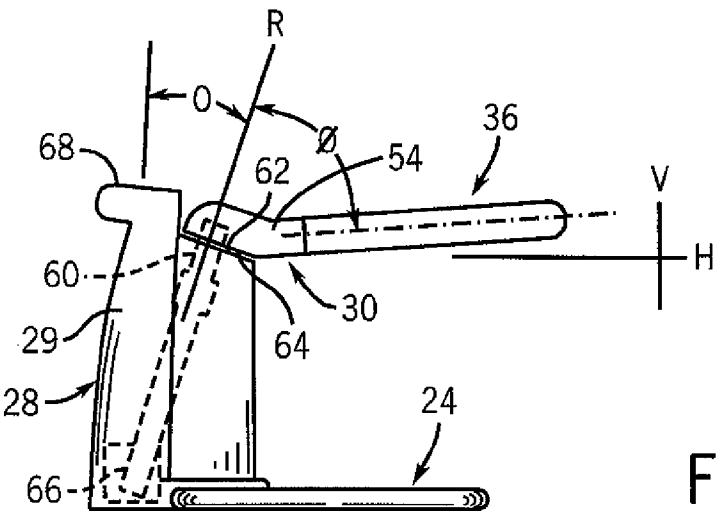
FIG. 5 is a schematic side view of the child motion device depicted in FIG. 4 and shows one example of the swing arm orientation for the child motion device.

The motion characteristics for the child motion device 20 disclosed herein can be achieved in a variety of ways with a variety of component geometries. FIGS. 4 and 5 illustrate only one example where FIG. 4 shows a top view of the child device 20 and FIG. 5 shows a side view. As shown, the support arm 30 can rotate and reciprocate through an arc of travel less than a full circle. In one example, the support arm 30 can rotate between two extremes E through an angle β of, for example, 120 degrees. This angle can vary and thus can be greater than or less than 120 degrees and yet can fall within the spirit and scope of the invention. The angle can be specifically designed to mimic motion that would be created by a caregiver holding and soothing a child. Such motion is much more dependent on the frequency of the travel cycle and not the angle of travel. Thus, depending on the speed of the rotary motion of the support arm, the resulting motion might reciprocate through or within an angle of movement much smaller than 120 degrees.

The support arm 30 is described herein as being substantially horizontal and the rotation axis R as being substantially vertical, even though they are angularly offset from these specific references. The support arm 30 can rotate about the axis of rotation R of a driven shaft 60, which could be aligned with the vertical axis or reference V. However, in the example shown the axis of rotation R of the shaft 60 is oriented at an angle θ toward the seat and support arm relative to the horizontal reference H and is perpendicular to its axis of rotation R. In one example, the angle θ can be about 13 degrees, but the angle θ can be less than 13 degrees, 0 degrees, or greater than 13 degrees, and yet fall within the spirit and scope of the invention. The axis of rotation R can even be tilted away from the seat 38 and support arm 30 if desired.

In this example, a top facing surface 62 on the housing 29 and a bottom facing surface 64 on the driven part 54 are oriented perpendicular to the axis R. A drive mechanism 66 can be employed to drive the shaft 60, which in turn will rotate the driven part 54 and the arm 30 about the axis R relative to the stationary surface 62 on the housing 29. In one example, the support arm 30 can be parallel to these surfaces 62 and 64 and thus be tilted downward at the angle θ, or 13 degrees in this example. However, the support arm 30 as shown has a bend that places the support arm inclined upward about 4 degrees relative to the horizontal reference plane H. The support arm is oriented at an angle Φ relative to the axis R, and in this example the angle Φ is 73 degrees.

In motion, the support arm 30 will sweep through its arc and travel in a cone-like path that is tilted 13 degrees to the horizontal reference H. Any given point on the child seat 38 and holder 36 will travel within a plane that is also titled to horizontal. The actual motion of the seat holder 36 will thus have an orbit component about its axis R, a vertical height component, and a rotational component about a lengthwise axis of the support arm 30. The holder 36 will vary in positional height between a low elevation point and a high elevation point as it moves along the path between the positional extremes E. These elevations can be set to occur anywhere along the travel arc, depending upon where the mid-point M of the travel arc of the seat holder 36 is designed to occur. If the mid-point M of the travel arc is set at the lowest elevation of the travel arc, equal high points will occur at the opposite travel extremes E of the arc. This configuration may best simulate the motion that a child might experience when held in a caregiver's arms.

Though not depicted herein, other component geometries are certainly possible. In one example, the axis of rotation R can be precisely vertical and co-linear with the vertical reference axis V (as well as the spine axis in this example). In such an example, the support arm could be tilted at an angle upward or downward from the horizontal reference H or be parallel to the reference H. The seat holder position would not vary in height and would travel in a horizontal plane through a partial circular arc. The support arm 30, depending on its angle to the reference H, could move through an arc of a cone segment and not in a plane. The seat holder 36 could be oriented parallel to the horizontal reference H and/or the support arm 30 or be inclined or declined at an angle relative to either or both, if desired. The support arm 30 or holder 36 can be bent such that, at least at the low elevation point, or the mid-point, of the travel arc, the seat 38 is oriented level with the floor surface 26 or horizontal reference H. Alternately, the arm 30 or holder 36 can be oriented to tilt toward or away from the spine 28. In one example, the seat holder angle relative to the support arm can even be user adjustable to provide additional motion alternatives to be imparted upon the seat occupant. In another example, the support arm length can also be user adjustable to provide further motion alternatives to be imparted upon the seat occupant.

Cam or non-planar surfaces at or near the driven end 32 of the support arm 30 can be employed, or other mechanical means can be devised, to impart optional vertical movement of the support arm as it sweeps through its travel arc. In one example, a four-bar or other mechanical linkage arrangement (not shown) can be employed in the drive system or even in the support arm and/or the holder construction to impart some vertical movement to the seat 38 during operation of the device 20. Such linkage arrangements could be employed to create optional motions in different directions including pivoting vertical movement of the arm, linear vertical movement of the arm, lengthwise longitudinal movement of the arm, lengthwise longitudinal rotation of the arm, or the like.

In addition, a vertical bouncing or oscillating motion can be imparted using a spring (not shown) in the drive components or in the support arm as well. Such a bouncing motion feature can optionally be designed as a separate motion option for the device, such that the child seat can be bounced even while the support arm does not reciprocate through the partial orbit about the axis R, or as an additional motion that can only occur along with the orbit movement of the support arm. The vertical motion can again be angular, such as by pivoting the support arm 30, or can be linear, such as by raising or lowering the entire support arm.

The type and complexity of the motion characteristics imparted to the support arm 30 disclosed herein can vary and yet fall within the spirit and scope of the invention. A user interface 68 can be provided on a surface of the spine 28 or housing 29. The user interface 68 can be configured to permit a caregiver to select, adjust, and operate characteristics of the drive mechanism and other functional aspects of the device 20. In one example, the device can be configured so that a user can select one of several operational modes for the drive mechanism. One variable that may be adjustable or selectable by the user from a plurality of different modes is the arc or angle β of support arm travel.

If desired, the support arm 30 can, for example, also be designed to travel through 360 degrees or more before changing directions during a reciprocating cycle. The seat holder 36 and/or the support arm 30 can also be angularly adjustable if desired, to further alter the motion experienced by a seat occupant. As mentioned above, the support arm can be length adjustable, if desired, to create even more motion versatility in the device 20. Alternatively, the seat position can be slidably adjustable or location-specific adjustable along the length of the support arm 30 from the distal or free end 34 inward toward the driven end 32.

Figure 3:
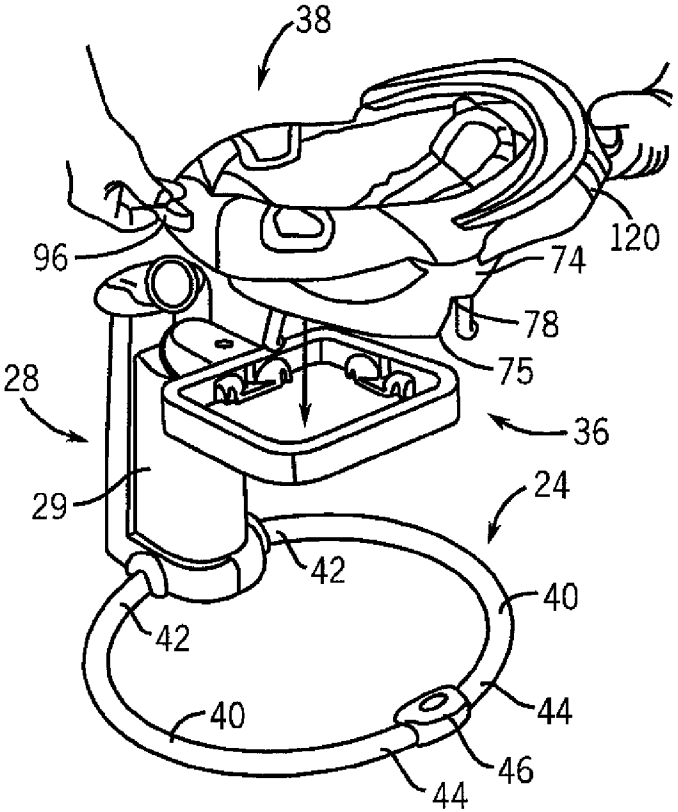
FIG. 3 shows a front perspective and partially exploded view of the child motion device in FIG. 1 but with the seat positioned just prior to attachment to the device in one optional seat facing orientation.

In one aspect of the present disclosure, the seat holder 36 is configured to permit the child seat 38 to be mounted on the support arm 30 in a number of optional seat facing orientations. In the example shown, the child seat 38 can have a contoured bottom 70 with features configured to engage with portions of the seat holder 36. The features can be configured so that when the seat is positioned over and lowered onto the seat holder 36 as in FIG. 3, the seat will securely engage and connect to the holder, such as shown in FIG. 1. The features can also be configured to enable different seats from different child care devices to be placed on and secured to the holder 36. One example of such features is described in greater detail below.

Figure 7:
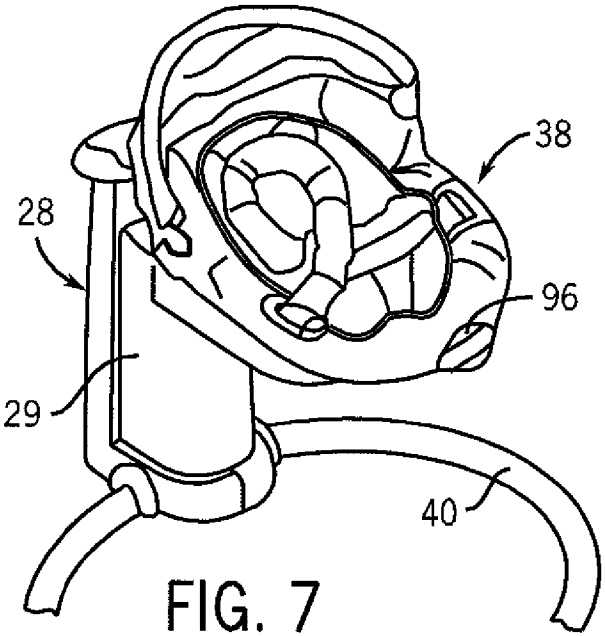
FIG. 7 shows the child motion device in FIGS. 1 and 3 but with the child seat attached to the device in yet another optional seat facing orientation.
Figure 6:
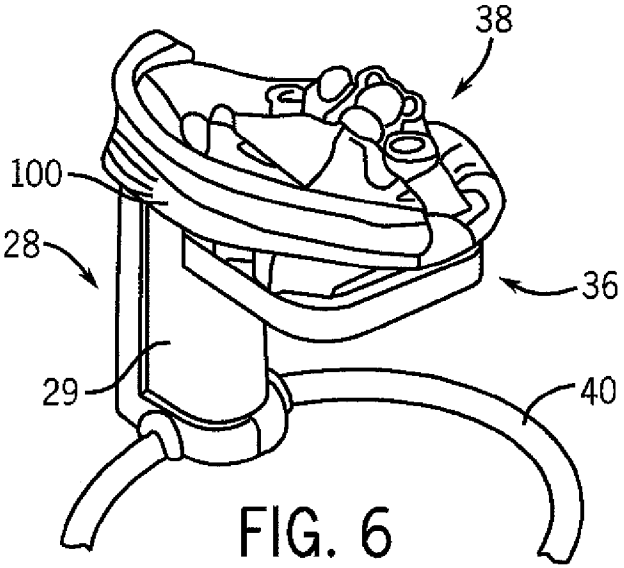
FIG. 6 shows the child motion device in FIGS. 1 and 3 but with the child seat attached to the device in another optional seat facing orientation.
Figure 8:
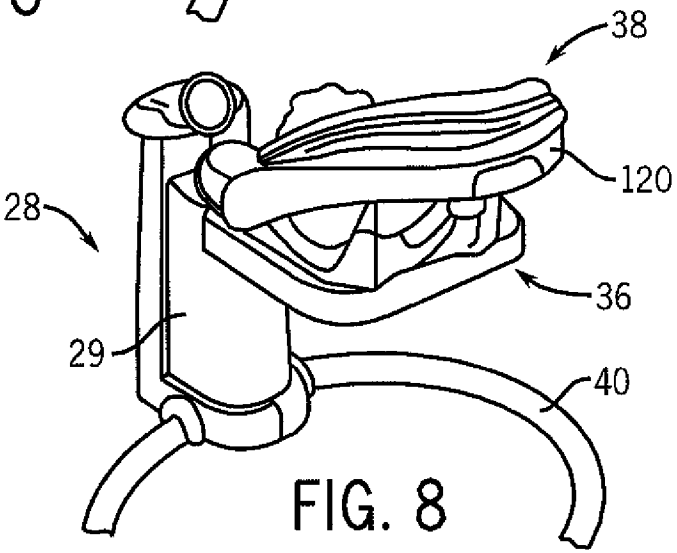
FIG. 8 shows the child motion device in FIGS. 1 and 3 but with the child seat attached to the device in still another optional seat facing orientation.

FIGS. 1 and 6-8 illustrate an array of optional child seat orientations that are rendered permissible by the square symmetrical shape of the seat holder 36 in this example. As shown in FIG. 1, the child seat 38 can be positioned on the seat holder 36 with the spine 28 and thus the axis of rotation R positioned on the right hand side of the child seat occupant. FIG. 6 shows another optional seat orientation where the position of the spine 28 and thus the rotation axis R is on the left hand side of the child seat 38. FIG. 7 shows another optional seat orientation where the position of the spine 28 and rotation axis R is located behind the child seat 38. FIG. 8 shows a further alternative seat orientation wherein the child seat 38 faces the spine 28 and the rotation axis R. By placing the seat 38 in these different optional seat orientations, the child can experience different relative motions and a variety of different visual environments without changing any other motion characteristic of the device 20.

Figure 9:
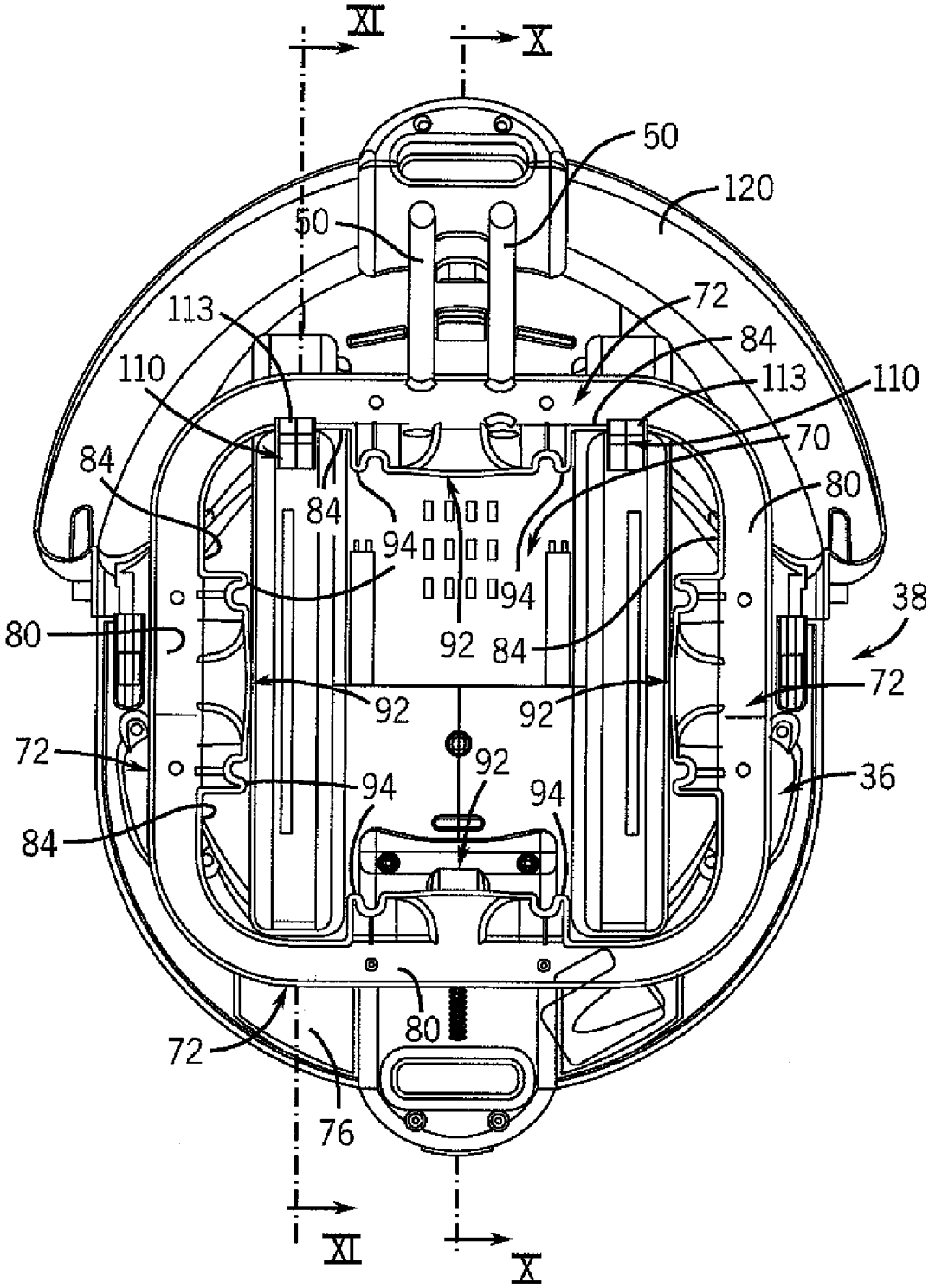
FIG. 9 shows a bottom view of the assembled seat and seat holder of the child motion device configured as depicted in FIG. 7.
Figure 10A:
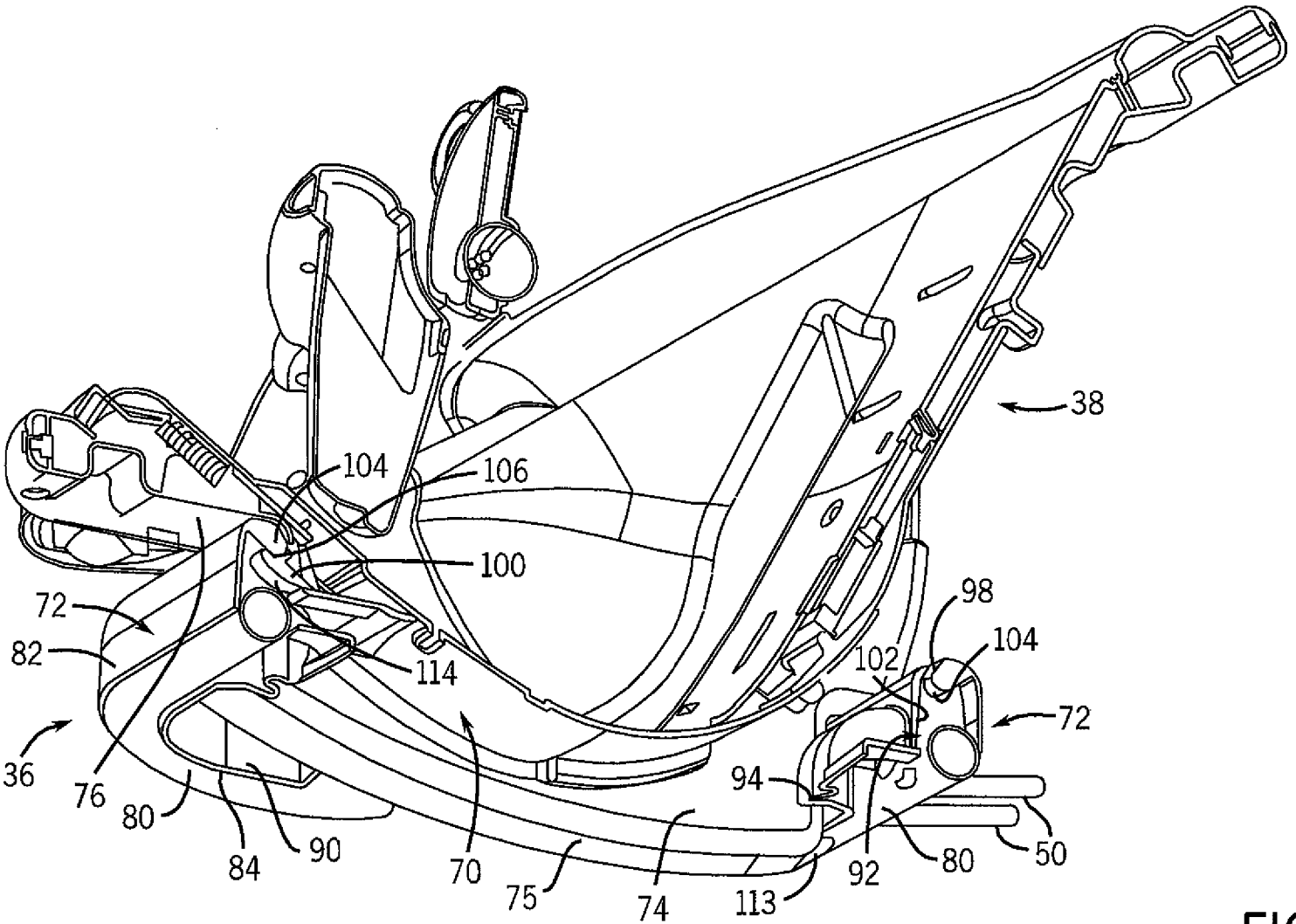
FIGS. 10A and 10B show a cross section in perspective and plan view, respectively, taken along line X-X in FIG. 9.
Figure 10B:
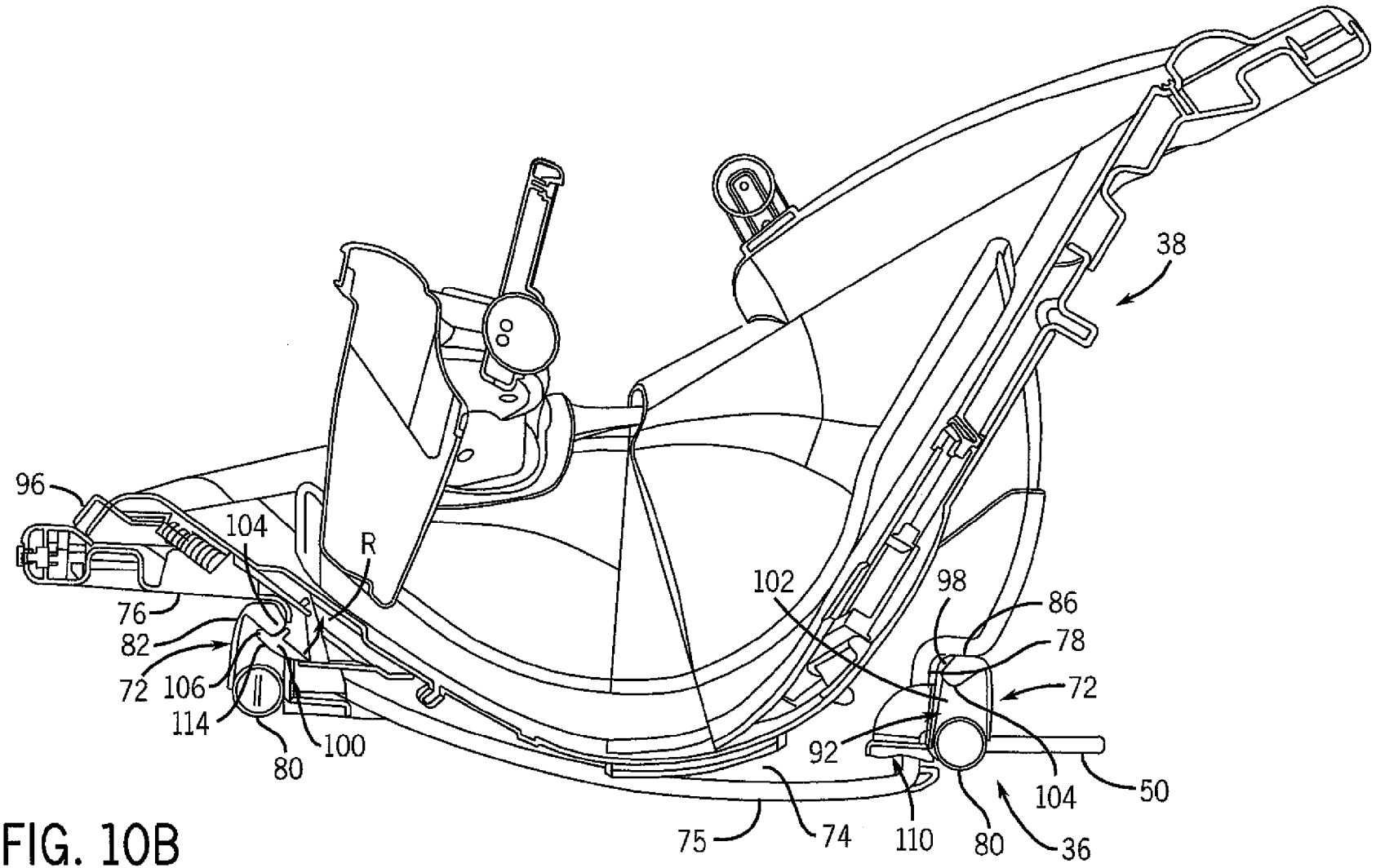

Referring to FIGS. 9, 10A, and 10B, the seat holder 36 in this example generally has four linear side segments 72 forming the square shape of the holder and surrounding the open center 56. The seat bottom 70 has a nesting portion that projects downward from the seat and fits within the open center 56. The nesting portion in this example is formed as a pair of rocker legs 74, which extend front to back under the seat 38, are spaced laterally apart from one another, and have curved bottom rocker surfaces 75 on which the seat 38 can rest and rock when placed on a flat surface. The legs register the seat 38 in the open center 56 of the seat holder 36 and help to retain the seat in position on and coupled to the holder A front ledge 76 is positioned forward of the legs 74 on the bottom 70 of the seat 38. The front ledge 76 is sized and positioned to rest on one of the segments 72 when the seat 38 is installed on the seat holder 36. A step or notch 78 is positioned near a rear end of each of the legs 74 and is formed upward into the rocker surface 75 on each leg. As shown in FIG. 10B, the notches 78 are sized and positioned to receive and rest on one of the holder segments 72 when the seat 38 is installed on the holder 36. The notches 78 also help to retain the seat 38 in position on and coupled to the holder.

Gravity alone can be relied upon to retain the seat 38 in position on the holder 36. In the disclosed configuration, the seat 28 could be placed in the holder 36 in any one of the four optional seat orientations and rely on gravity to retain the seat. However, one or more positive manual or automatic latching mechanisms can be employed to positively secure the seat when installed on the holder. In the disclosed example, components or elements of a latching mechanism are provided on the bottom 70 of the seat 38 and other components or elements of the mechanism are provided on each of the segments 72 of the holder 36. As shown in FIGS. 2 and 9, each holder segment 72 includes multi-function latch components configured to accept and connect to seat latch components (described below) on either end of the seat 38. Thus, each pair of opposed segments 72 of the square holder 36 in this example has an identical latch component arrangement. The seat 38 can be installed on the holder in any orientation and engage a pair of the segments 72.

As shown in FIGS. 10A-11B, the holder 36 is formed having a square shaped tubular ring with four segments 80 corresponding with the holder segments 72. The holder 36 also has a shroud or cover 82 that seats over the ring and covers each of the tube segments 80. In this example, the cover 82 is a molded plastic component that has an inverted U-shape in cross section. Thus, the cover has a curved, rounded top 86 and inner and outer exposed bottom edges 84 and 88, respectively. The cover 82 can be fastened to the tubes 80 in a conventional manner.

In this example, the inside wall 90 of the cover 82 on each segment 72 is molded to include multiple ones of the holder latch elements or components. A first latch element is molded on the wall and is configured to engage one element on the seat 38 and a second latch element of the wall is configured to engage another element on the seat, depending on the seat orientation when installed on the holder 36. As depicted generally in FIGS. 10A and 10B, the first latch element on each holder segment 72 is a central catch 92. In this example, the catch 92 is flanked on either side by the pair of hooks 94, which are spaced apart from one another. In this example, the second latch element for the seat 38 is the underside inner edge 84 on the wall 90 of each segment of the cover 82. The pair of hooks 94 act as alternate second latch elements for engaging an alternate seat installed on the holder, as described below.

Complementary third and fourth latch elements are provided in this example on the bottom 70 of the seat 38. The third latch element is positioned near the front end of the seat, which includes an actuator 96, and the fourth latch element is positioned near the rear end of the seat. The third latch element is configured to receive and engage the first latch element, the catch 92, and the fourth latch element is configured to engage the second latch element, the inner bottom edge 84 of the cover wall 90, in this example. As shown in FIGS. 9, 10A, and 10B, the third latch element is a pivot latch 100 that is carried on the bottom 70 of the seat 38 near the front end and between the legs 74. The latch 100 in this example is spring biased to a latching position shown in FIGS. 10A and 10B and is actuable against the spring bias by movement of the actuator 96. In this example, the actuator 96 is a push button on the forward end of the seat that, when depressed or pushed inward, pivots the latch 100 rearward to a retracted or withdrawn release position as shown in FIG. 10B in the direction of the arrow R. As will be evident to those having ordinary skill in the art, the actuator 96 can be a pull lever or some other type of actuator and can be located on a part of the seat 38 other than the front edge. The actuator 96 need only be actuable to move the latch between the latching position and the released position.

The catch 92 in this example has a latch opening 102 positioned beneath a catching lip 104. The opening 102 and lip 104 are integrally molded in the cover 82 on each segment 72 in this example. The latch opening 102 of each holder segment 72 faces the open center 56 of the holder 36 and thus the opposite holder segment 72. The latch opening 102 opens into the corresponding segment 72. The catch lip 104 is positioned at the top of the corresponding latch opening 102 on each of the holder segments. In this example, the lip is an integrally molded element of the cover under the top surface 86. When the seat 38 is installed on the holder 36, the latch 100 is biased into the opening 102 and has a finger 106 that hooks under the lip 104. In this example, a surface 98 above the catch 92 on the cover 82 can act as a latch bearing surface as described below.

Figure 11A:
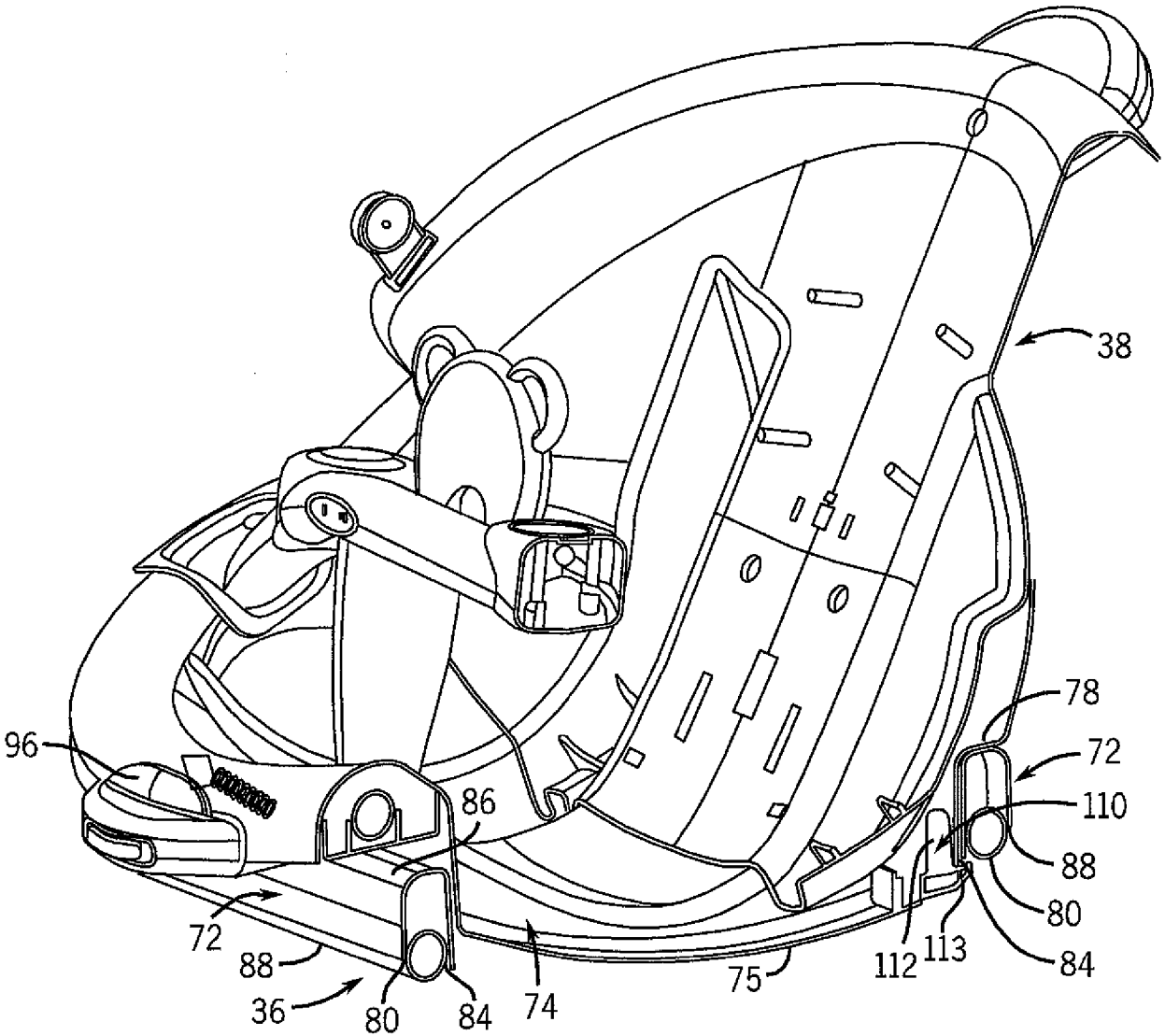
FIGS. 11A and 11B show a cross section in perspective and plan view, respectively, taken along line XI-XI in FIG. 9.
Figure 11B:
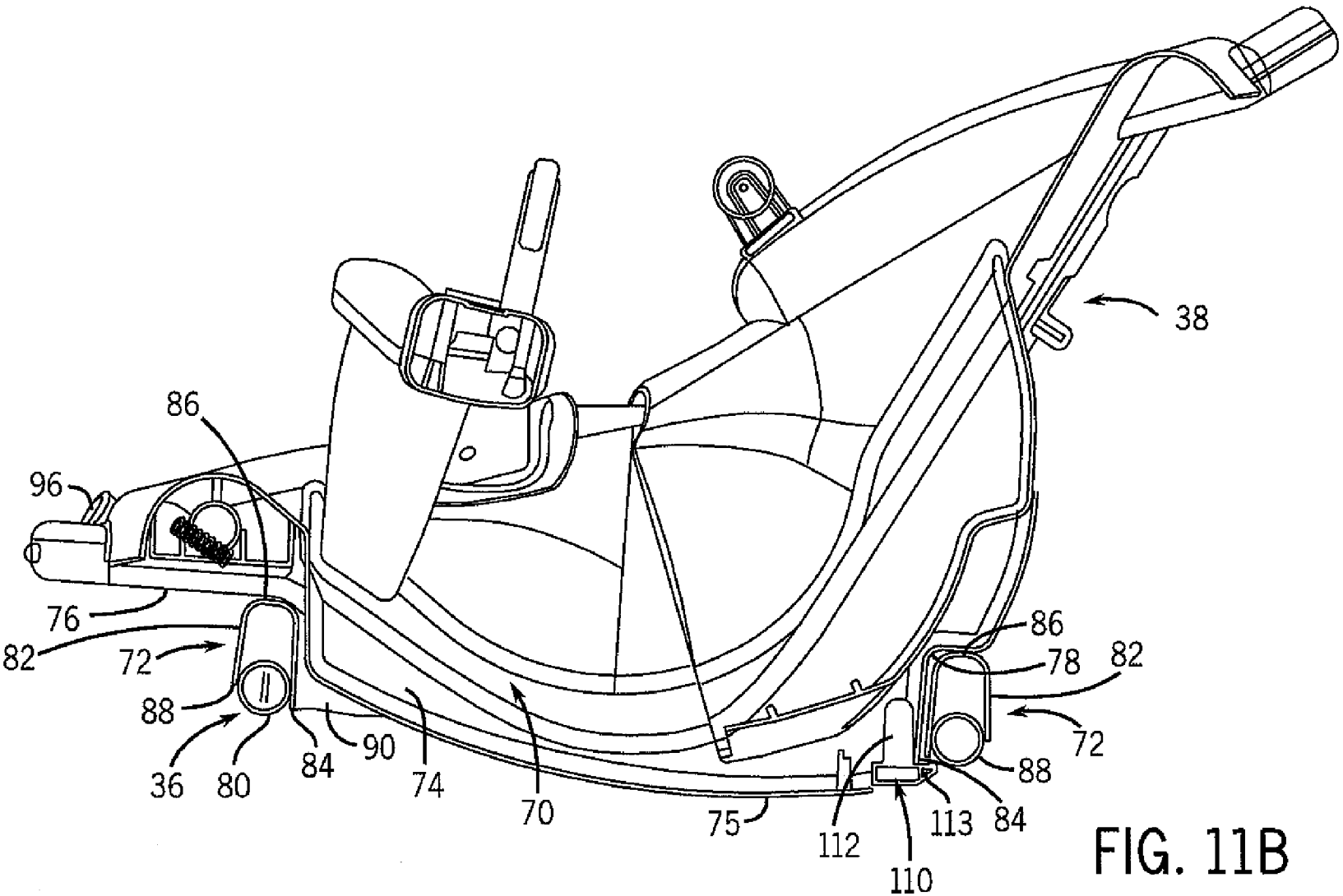

As shown in FIGS. 9, 11A, and 11B, the fourth latch element is a pair of feet 110 that project rearward from the lower edge of the legs 74 near the rear end of the seat. In this example, the feet 110 are laterally spaced apart from one another a distance that is greater than a spacing of the alternate second latch elements or hooks 84 on the segments 72. The feet 110 are sized and positioned to catch under the exposed inner edge 84 on the inner wall 90 of the cover 82. As shown in FIG. 9, the feet 110 are positioned outboard of the hooks 94 when the seat is installed. In this example, the feet 110 are aligned with the legs 74 of the seat. Specifically, each foot 110 has a stem 112 that is received in a bore in the bottom 75 of each leg 74. The feet 110 extend rearward from the stems 112 and a surface of the legs 74 below the notches 78. The projecting part 113 of each foot 110 catches under the edge 84 when a segment 72 is positioned abutting the notches 78 as depicted in FIGS. 11A and 11B.

When a caregiver wishes to install the seat 38 on the device 20, the caregiver need only place the seat above the holder 36 in a desired one of the four seat orientations in FIGS. 1 and 6-8 noted above. The seat 38 can then be tipped, rear end down, so that the notches 78 seat on the selected holder segment 72. The spacing and positioning of the legs 74 will correctly aligned the feet 110 with the bottom edge 84 of the cover on the adjacent holder segment 72 with the nearby hooks 94 inboard between the feet. The caregiver can then rotate the front end of the seat 38 down, which will in turn rotate the projecting parts 113 of the feet 110 under the edge 84 of the cover 82. The front end of the seat 38 can then be lowered into position on the holder 36 with the ledge 76 resting on the opposite segment 72. In one example, an exposed, curved cam face 114 on the latch 100 can be configured to ride against the corresponding cover surface 98 above the catch 92. The cam face 114 can act to push or rotate the latch 100 out of the way for automatic installation. Once the seat 38 drops into position, the spring bias can then automatically pop or snap the latch 100 into the latch opening 102. In another example, the latch 100 can be configured so that the user must use the actuator 96 to manually move the latch 100 out of the way before dropping the seat 38 into position on the holder 36.

Whether manual or automatic, once the latch 100 clears the surface 98 on the segment 72, the latch will rotate to the latched position and be held in the latched position by the spring bias and the geometry of the latch and actuator components. The seat 38 can be positioned with its front and rear ends adjacent any one of the holder segments 72. Each of the holder segments 72 has both a catch 92 and an exposed bottom edge 84 on the cover 82. Thus, each of the holder segments can accept and engage either of the seat latch components.

To release the seat 38 from the holder 36, a user need only push the actuator button 96 into the seat in this example. Pushing the actuator button 96 causes the latch 100 to withdraw or retract from the catch opening 102 and clear the lip 104. The user can then raise the front end of the seat 38. Tipping the front end of the seat upward will pivot the projecting parts 113 of the feet 110 out from under the edge 84 on the cover 82, allowing the caregiver to lift the seat off of the holder 36.

As will be evident to those having ordinary skill in the art, the specific configuration and construction of the first, second (as well as the alternate second), third, and fourth latching elements can vary from the examples shown. In one example, the various hooks, loops, catches, and latch can be swapped with one another and/or replaced by other suitable mechanisms. Alternatively, the elements on the front end of the seat can be of the same type as the back end of the seat, with one of the elements being movable for installation and/or release of the seat. Additionally, the latch elements can be on the opposed sides of the seat, not on the front and back, or can be directly under a mid-point of the seat. In one example, the second latch element can be the hooks 94 on each of the segments 72 and the fourth latch elements on the seat 38 can be loops (see description below for the alternate carrier 222)

In the disclosed example, the seat 38 is configured as a dedicated seat specifically for use with the child motion device 20. The seat has a handle 120 that can pivot up to a position extending over the seating area of the seat, thus allowing the seat to be used as an infant carrier when removed from the device 20. In one example, the seat 38 can also be configured to attach to one or more other child supporting, soothing, motion, or entertainment devices such as a car seat base, a stroller frame, a bouncer frame, a pendulum swing frame, an entertainer, or the like. Thus, the seat 38 could be a multi-purpose seat that has separate utility other than use on the device 20. Such other devices could be designed with latch elements configured to mate with the third and fourth latch elements of the seat 38. In one example, such other devices could include a catch for the latch 100 and hooks or other exposed surfaces for the feet 110.

Figure 13:
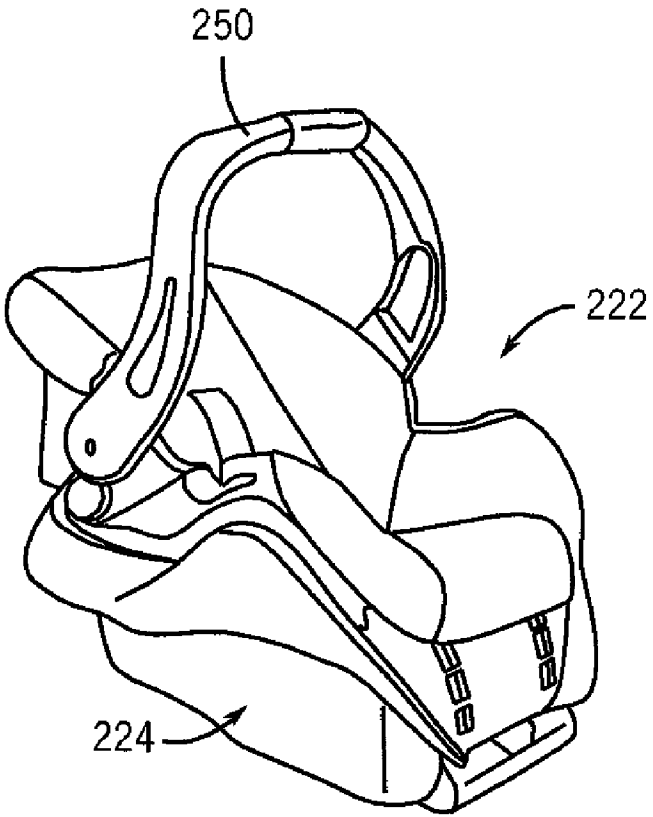
FIG. 13 shows a perspective view of the infant carrier in FIG. 12 installed on a car seat base.
Figure 12:
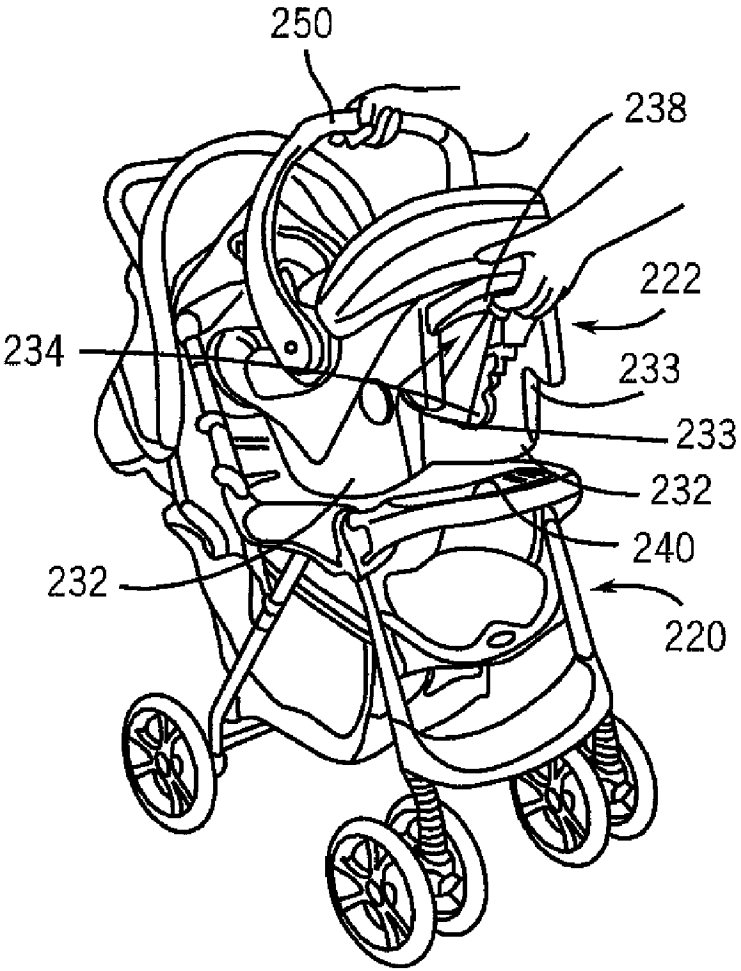
FIG. 12 shows a rear perspective view of a stroller frame with an infant carrier being installed on or removed from the frame.

In another example, the holder 36 can be configured to accept and engage one or more seats removed from other child supporting, soothing, motion, or entertainment devices such as car seats, stroller seats, infant carriers, bouncer seats, pendulum swing seats, entertainer seats, or the like. FIGS. 12-18 illustrate one such example. A stroller 220 is shown in FIG. 12 with an infant carrier 222 installed on the stroller as is known in the art. In FIG. 13, the same infant carrier 222 is shown installed on a car seat base 224 as is also known in the art. The top side of the car seat base 224 is shown after removal of the carrier 222 in FIG. 14.

Figure 15:
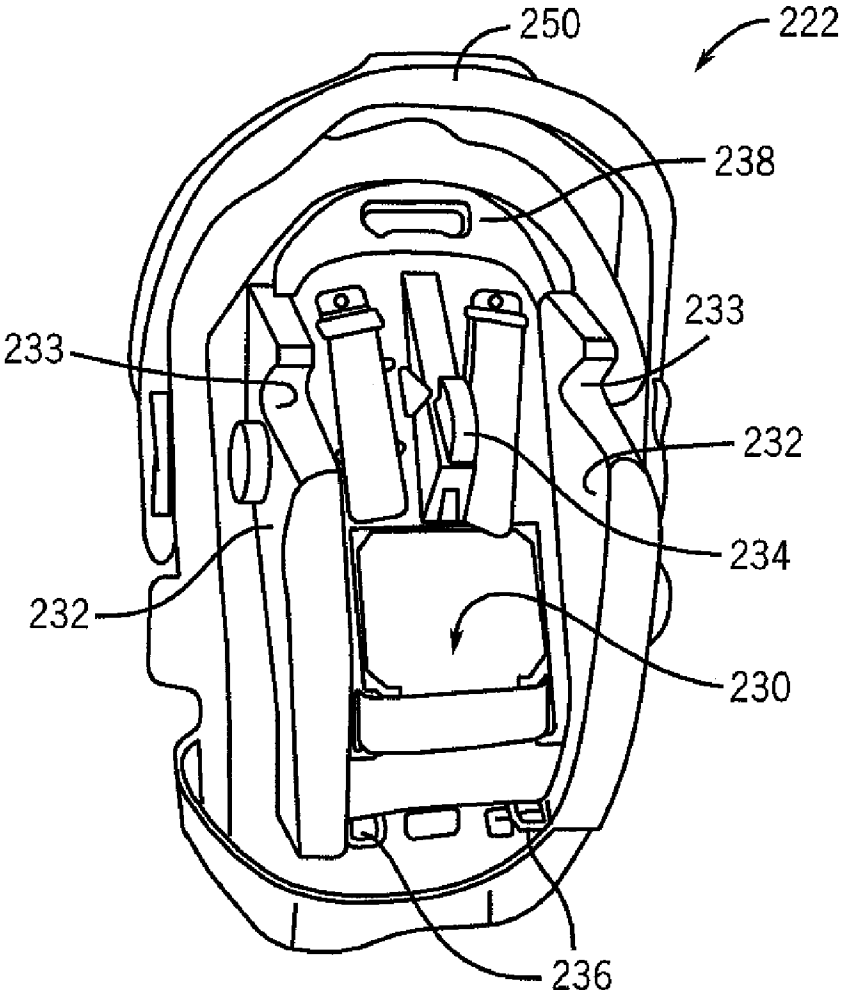
FIG. 15 shows a bottom perspective view of the infant cater in FIGS. 12 and 13.
Figure 14:
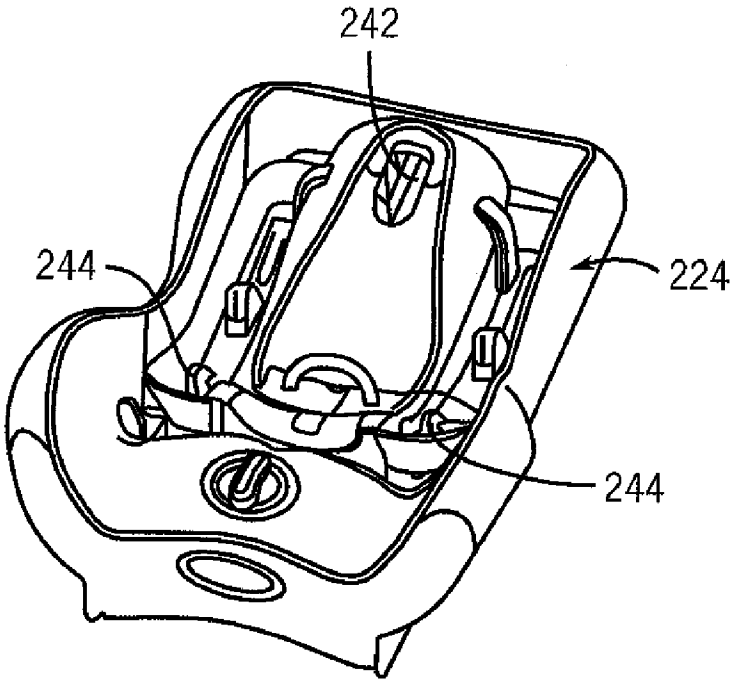
FIG. 14 shows the care seat base in FIG. 13 without the infant carrier.
Figure 16:
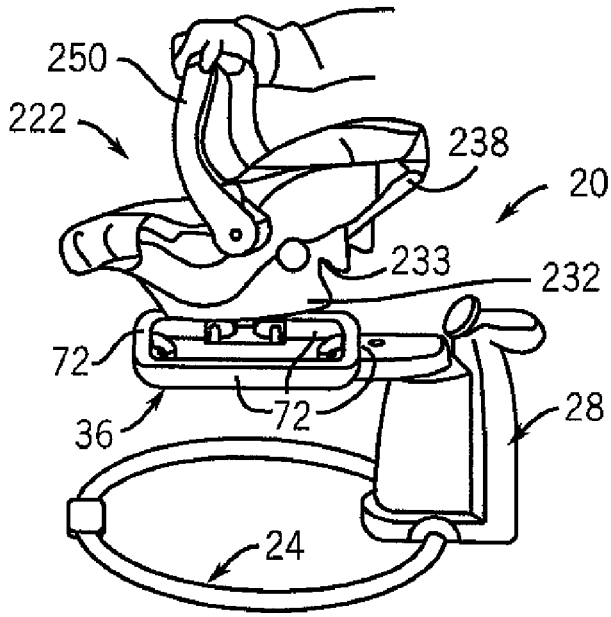
FIG. 16 shows the infant carrier in FIGS. 12 and 13 being positioned over the child motion device in FIGS. 1-8.
Figure 17:
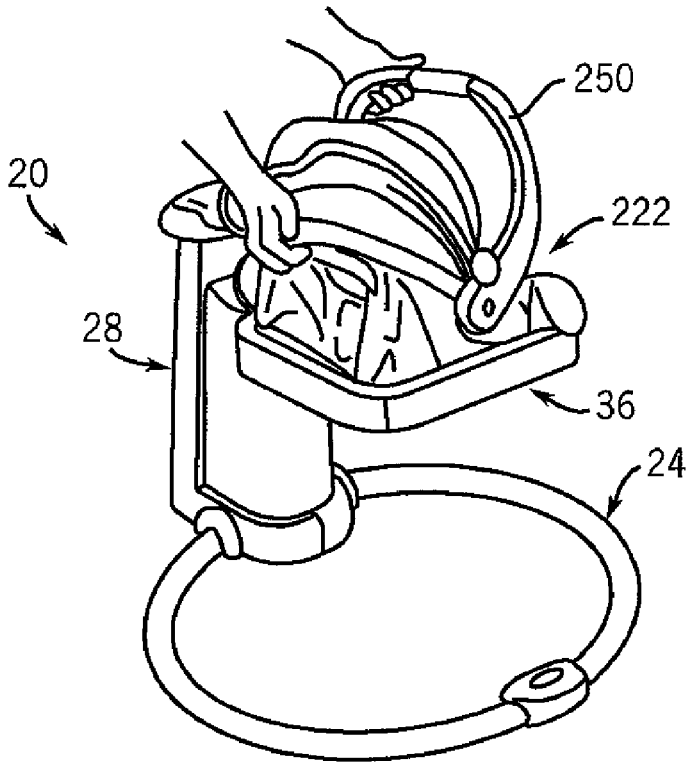
FIG. 17 shows the infant carrier in FIG. 16 during installation on the seat holder of the child motion device in FIGS. 1-8.
Figure 18:
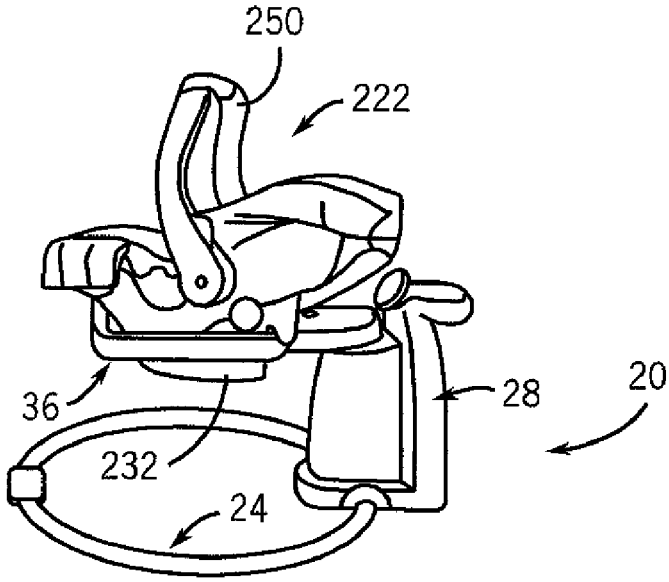
FIG. 18 shows the infant carrier installed on the child motion device in FIGS. 1-8.

FIG. 15 shows a bottom view of the carrier 222. In this example, a bottom 230 of the carrier 222 has a pair of depending legs 232 with notches 233, and complementary fifth and sixth latch elements. The fifth latch element is positioned near the rear end of the seat 222 and the sixth latch element is positioned near the front end of the seat. The fifth latch element is configured to receive and engage the catch 92 and the sixth latch element is configured to engage the hooks 94 on the device 20 in this example. As shown in FIG. 15, the fifth latch element is a pivot latch 234 that is carried on the bottom 230 of the carrier 220 near the rear end and between the legs 232. The latch 234 in this example is spring biased to a latching position and is actuable against the spring bias by movement of the actuator 238 on the rear end of the carrier. In this example, the actuator 238 is a pull lever that, when pulled are drawn rearward along the carrier 222, pivots the latch 234 forward to a retracted or withdrawn release position. As will be evident to those having ordinary skill in the art, the actuator 238 can be a push button or some other type of actuator and can be located on a part of the seat 38 other than the rear end. The actuator 238 need only be actuable to move the latch between the latching position and the released position.

As shown in FIG. 15, the sixth latch element is a pair of loops 236 that project downward from the bottom 230 near the front end of the carrier 222. In this example, the loops 236 are laterally spaced apart from one another a distance that matches the spacing of the second latch elements or hooks 94 on the segments 72 of the device 20. The loops 236 are sized and positioned to catch under a respective one of the hooks 94 when the seat is installed as described below. In this example, the loops 236 are positioned between the legs 232 of the carrier 222.

As will be evident to those having ordinary skill in the art, the specific configuration and construction of the fifth and sixth latching elements can vary from the example shown. In one example, the various hooks, loops, catches, and latch can be swapped with one another and/or replaced by other suitable mechanisms. Alternatively, the elements on the front end of the seat can be the same as the back end of the seat, with one of the elements being movable for installation and/or release of the seat. In the disclosed example, the carrier also has a handle 250 that can pivot up to a position extending over the seating area of the carrier, thus allowing the infant carrier to be carried when removed from the devices.

The loops 236 are positioned near the front end of the carrier 222 on the bottom 230 and the latch 234 is positioned nearer the rear end of the carrier bottom. An actuator 238 is exposed on the back side of the carrier behind the seat. When the carrier 222 is mounted on the stroller 220 in this example, the latch 234 can catch on an underside of the stroller tray 240 as shown in FIG. 12. The loops 236 can hook under hooks (not shown) on the stroller 220. When the carrier 222 is mounted to the car seat base 224, the latch 234 can catch in a receiver 242 on the top of the base. The loops 236 can hook under hooks 244 on the car seat base 224. Similar hooks (not shown) can be provided on the stroller 220. The actuator 238 can move the latch 234 between a latched position and a release position. The carrier 222 in this example is installed front end first and removed rear end first, but otherwise operates generally similar to the seat 38 described above.

Figure 19:
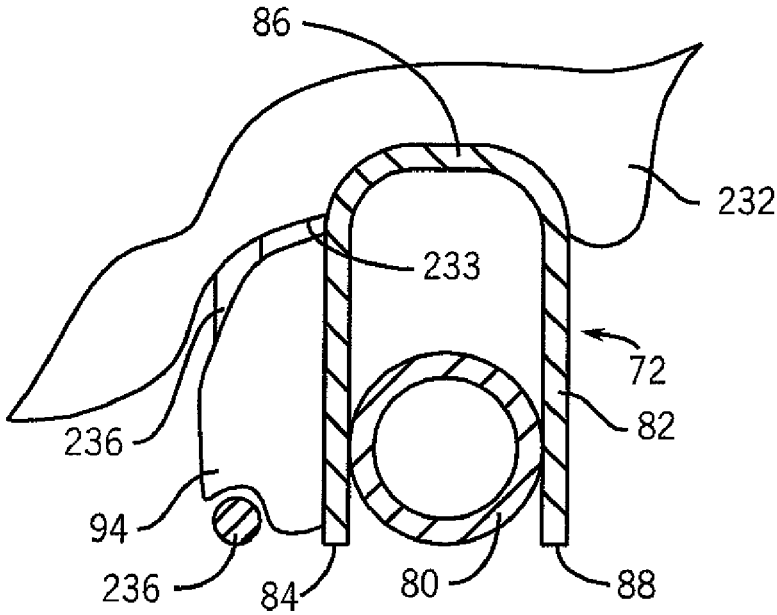
FIG. 19 is a close up view of a latch element connection between the infant carrier and the seat holder in FIG. 18.

If a caregiver wishes to remove the carrier 222 from the stroller frame 220 or the car seat base 224, they need only pull or push the actuator 238 to release the latch 234. The caregiver can then tip the carrier 222 up, rear end first, to unhook the loops 236 from the hooks (244 on the base 224), and then lift the carrier off the device. The caregiver can then install the carrier 222 in any one of the desired orientations in FIGS. 1 and 6-8 on the seat holder 36 of the child motion device 20 as shown in FIGS. 16-19. To do so, the caregiver can position the front end of the carrier 222 and the loops 236 adjacent the desired holder segment 72 and drop the carrier, front end first, into the open center 56. They then can drop the rear end of the carrier 222 onto the holder 36. The loops 236 will rotate forward into engagement with the hooks 94 as depicted in FIG. 19. The latch 234 can be manually retracted using the actuator 238 or can automatically retract as its exposed cam surface 246 contacts the surface 96 on the cover 82 of the corresponding holder segment 72. Once the carrier 222 rests on top of the holder 36, the latch 234 can be manually released by releasing the actuator 238 or will automatically will snap or pop into and engage the catch 92. The latch will assist to secure the carrier 222 on the device 20. In this example, the carrier 222 is suitable for use at least as a car seat with the base 224, as a stroller infant seat on the stroller frame 220, as a conventional infant carrier 222, and as a seat for the child motion device 20 herein.

In the disclosed example, both the seat 38 and the carrier 222 can be mounted or installed on the child motion device in any one of four selectable positions. In another example, the holder 36 and/or the seats 38, 222 can be cooperatively designed to permit the seat or other child supporting device to be installed on the holder 36, or rotated once installed, between fewer than four, more than four, or even an infinite number of seat facing orientations when placed on the holder. Cooperating discs on the two parts could be employed to achieve infinite orientation adjustment. Alternatively, a round holder could be employed in conjunction with a seat bottom that is configured to attach to the holder at any location and seat facing orientation to achieve the same result.

The child motion device 20 depicted and describe herein is constructed according to the invention to simulate or mimic various movements that might be employed by a mother or father as they hold a child in their arms. An adult holding a child will often alternate raising and lowering their shoulders or pivoting their torso from side-to-side to simulate a rocking movement. Other times, an adult may hold the child in their arms and twist their torso from side-to-side creating a motion for the child through a segment of an arc. Other times, the adult may simply sway the child back and forth by laterally moving their elbows from side to side while holding the child. Sometimes an adult may employ a combination of such movements and/or may lean forward and tilt their spine at an angle toward the child when doing these motions.

In any instance, an adult can easily alter the position of the child held in their arms. Sometimes an adult may hold a child in a somewhat seated position with the child facing away from their chest. In another example, the child may be held in a position looking directly at the adult. In another example, the child may be held with their legs to one side and head to another side and rocked by the adult. The disclosed child motion devices can simulate any or all of these various proven, natural, calming and soothing movements. Parents usually hold their child and move them in a slow, even rhythm to help calm or soothe the child. The disclosed device 20 can be constructed to operate in a manner that also mimics the degree and frequency of motion that a child might experience when held in an adult's arms.

The drive mechanism 66 can be configured to reciprocally rotate the shaft 60, and thus the support arm 30, through a predetermined travel angle, such as 120 degrees as mentioned above. The motor or drive mechanism 66 can be configured for manipulation by a user to adjust the angular travel, the speed of rotation, and the like. The user interface 68 in the form of an operator panel, touch pad device, a remote control unit, or other interface can be provided on a portion of the housing 29 (see FIG. 1) with buttons, a touch screen, a keypad, switches, combinations of these features, or the like that a user can manipulate to access, operate, adjust, and alter various performance characteristics of the device 20.

Other details of the child motion device disclosed herein can also vary considerably and yet fall within the spirit and scope of the present invention. The construction and materials used to form the frame assembly parts, the spine parts, and the added features can vary from plastics, to steel tubing, to other suitable materials and part structures. The drive system 66 components can also vary, as can the features employed in the drive system to create desired motions and functions for the disclosed devices. The housing 29 can have a top cap that rotates with and/or is integrally a part of the swing arm instead of the driven part 54 as shown. Alternatively, the housing 29 can provide a platform as shown on the top or on a side of the spine such that the driven end of the support arm is supported by the platform and rotates relative to it the platform.

The child seat bottom or base can be configured so that it engages with the seat holder in alternative manners from that shown and described herein. Gravity and the weight of a child can be enough to retain the seat in the holder. However, positive latching structures can be employed and are disclosed in the example herein. The seat 38 can also be configured to include common features such as a harness system, carrying handles, a pivotable tray, and a hard plastic shell. The bottom of the seat 38 can have a rocking, bouncing, or stationary support structure configuration and the seat can employ a pad, cover, or other suitable soft goods. As noted above, the seat holder can be configured to hold other devices such as a bassinet or other child supporting device.

The seat can also be configured to mate within a platform or system of related products. In other words, the seat could be removable from one of the disclosed motion devices and readily placed in a different product that is configured to accept the seat. Such related products can be, for example, a cradle swing frame, a standard pendulum-type swing frame, a bouncer frame, a stroller, a car seat base, or an entertainment platform. In this way, the product system can be useful as a soothing or calming device when a child is young then be transformed for use as an entertainment device. In another example, the child seat could be fixed to the support arm and not removable.

Although certain child motion devices have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child motion device comprising:

a frame assembly configured to rest on a floor surface;

a drive system defining a generally vertical axis of rotation;

a support arm supported above the floor surface by the frame assembly and cantilevered from near the axis of rotation, the support arm having a driven end coupled to the drive system which pivotally reciprocates the support arm through a partial orbit around the axis of rotation;

a seat holder carried by the support arm, spaced from the driven end, and including first through fourth holder segments, each having an identical latch component arrangement; and a seat supported by the seat holder, wherein the seat and the first through fourth holder segments are constructed to permit the seat to be selectively positioned on the seat holder in more than one optional seat facing orientation.

2. A child motion device according to claim 1, wherein the seat can be removed from the seat holder and is usable as a seat when removed.

3. A child motion device according to claim 1, wherein the axis of rotation of the support arm is oriented at an angle of about 13 degrees from a vertical reference and toward the support arm, and wherein the support arm is oriented at an upward angle of about 4 degrees relative to a horizontal reference defined by the floor surface.

4. A child motion device according to claim 1, wherein two of the first through fourth holder segments are spaced apart holder segments each having a first latch element and a second latch element, and wherein the seat has a third latch element configured to engage the first latch element of either one of the two spaced apart holder segments and has a fourth latch element configured to engage the second latch element of either one of the two spaced apart holder segments.

5. A child motion device according to claim 4, wherein the first latch element is a catch with an opening and an exposed lip within the opening, and the third latch element is a pivotable latch on a bottom of the seat shaped to engage the lip within the opening in a latched position.

6. A child motion device according to claim 5, wherein the seat has an actuator that can effect movement of the pivotable latch between the latched position and a release position retracted from the opening.

7. A child motion device according to claim 4, wherein the second latch element is an exposed bottom edge on each of the holder segments, and the fourth latch element is a pair of feet that are spaced apart on and project from the bottom of the seat, each of the feet arranged to catch under the bottom edge of the holder segments when the seat is positioned on the seat holder.

8. A child motion device according to claim 1, wherein the seat is an infant carrier with a handle and is also attachable to and removable from a car seat base separate from the child motion device.

9. A child motion device according to claim 1, wherein the first through fourth holder segments are arranged to form a square shape surrounding a center opening.

10. A child motion device according to claim 9, wherein each of the holder segments has a first latch element and a second latch element, wherein the seat has a third latch element configured to engage the first latch element of any one of the four holder segments and has a fourth latch element configured to engage the second latch element of any one of the four holder segments, and wherein the seat can be positioned on the seat holder in any one of four optional seat facing orientations.

11. A child motion device according to claim 9, wherein the seat can rest on the seat holder in any one of four optional seat facing orientations including a first orientation facing the support arm, a second orientation facing away from the support arm, a third orientation with the support arm positioned on the left side of the seat, and a fourth orientation with the support arm positioned on the right side of the seat.

12. A child motion device according to claim 1, wherein the seat holder is a ring surrounding an opening and wherein the seat has a nesting part on a bottom of the seat that registers within the opening.

13. A child motion device according to claim 12, wherein the nesting part has an upward notch and a part of the ring seats in the notch with the seat positioned on the seat holder.

14. A child motion device according to claim 12, wherein the first through fourth holder segments form a square ring and wherein the seat can be positioned on the ring in any one of four optional seat facing orientations including a first orientation facing the support arm, a second orientation facing away from the support arm, a third orientation with the support arm positioned on the left side of the seat, and a fourth orientation with the support arm positioned on the right side of the seat.

15. A child motion device according to claim 14, wherein each of the first through fourth holder segments and the seat have latch elements arranged to allow the seat to be latched on the seat holder in any one of the four optional seat facing orientations.

16. A child seat system comprising:

a car seat base;

a frame assembly configured to rest on a floor surface;

a drive system defining a generally vertical axis of rotation;

a support arm supported above the floor surface by the frame assembly and cantilevered from near the axis of rotation, the support arm having a driven end coupled to the drive system, which pivotally reciprocates the support arm through a partial orbit around the axis of rotation;

a seat holder carried by the support arm spaced from the driven end; and a seat removable from and attachable to the seat holder and removable from and attachable to the car seat base;

wherein the seat holder has first through fourth holder segments, each having an identical latch component arrangement to permit the seat to be installed on the seat holder in more than one seat facing orientation.

17. A child seat system according to claim 16, wherein each holder segment has a first latch element and a second latch element, wherein the seat has a third latch element configured to engage the first latch element and has a fourth latch element configured to engage the second latch element with the seat installed on the seat holder, and wherein the car seat base has a fifth latch element configured to engage the third latch element on the seat base when installed on the car seat base.

18. A child seat system according to claim 17, wherein two of the first through fourth holder segments are spaced apart holder segments, each having one of the first and second latch elements and arranged to permit the seat to be installed on the seat holder in two different seat facing orientations.

19. A child motion device system comprising:

a frame assembly;

a seat holder supported by the frame assembly and including two spaced apart holder segments each having a first latch element and a second latch element;

a seat supported by the seat holder and including a third latch element configured to engage the first latch element of either one of the two holder segments and a fourth latch element configured to engage the second latch element of either one of the two holder segments; and an alternate seat from a different device, the alternate seat having a fifth latch element different from both the third and fourth latch elements and configured to engage a sixth latch element different from both the first and second latch elements, wherein both the seat and the alternate seat can be installed on the seat holder in two different seat facing directions.

20. A child motion device system according to claim 19, wherein the seat holder includes four holder segments in a square arrangement.

21. A child motion device system according to claim 19, wherein the seat holder includes four holder segments, each holder segment including the first and second latch elements.

22. A child motion device system according to claim 21, wherein each holder segment has an identical latch component arrangement such that the seat can be installed in four different seat facing orientations.

23. A child motion device system according to claim 19, wherein the seat holder includes the sixth latch element.

24. A child seat system comprising:

a car seat base;

a frame assembly configured to rest on a floor surface;

a drive system defining a generally vertical axis of rotation;

a support arm supported above the floor surface by the frame assembly and cantilevered from near the axis of rotation, the support arm having a driven end coupled to the drive system, which pivotally reciprocates the support arm through a partial orbit around the axis of rotation;

a seat holder carried by the support arm, spaced from the driven end, and having two spaced apart holder segments, each holder segment having a first latch element and a second latch element; and a seat removable from and attachable to the seat holder and removable from and attachable to the car seat base, wherein the seat has a third latch element configured to engage the first latch element and has a fourth latch element configured to engage the second latch element with the seat installed on the seat holder;

wherein the car seat base has a fifth latch element configured to engage the third latch element on the seat base when installed on the car seat base, and wherein each holder segment is arranged to permit the seat to be installed on the seat holder in two different seat facing orientations.

25. A child motion device comprising:

a frame assembly configured to rest on a floor surface;

a drive system defining a generally vertical axis of rotation;

a support arm supported above the floor surface by the frame assembly and cantilevered from near the axis of rotation, the support arm having a driven end coupled to the drive system which pivotally reciprocates the support arm through a partial orbit around the axis of rotation;

a seat holder carried by the support arm and spaced from the driven end, wherein the seat holder has four holder segments arranged to form a square shape surrounding a center opening; and a seat supported by the seat holder, wherein the seat and seat holder are constructed to permit the seat to be selectively positioned on the seat holder in more than one optional seat facing orientation, wherein each of the holder segments has a first latch element and a second latch element, wherein the seat has a third latch element configured to engage the first latch element of any one of the four holder segments and has a fourth latch element configured to engage the second latch element of any one of the four holder segments, and wherein the seat can be positioned on the seat holder in any one of four optional seat facing orientations.

26. A child motion device comprising:

a frame assembly configured to rest on a floor surface;

a drive system defining a generally vertical axis of rotation;

a support arm supported above the floor surface by the frame assembly and cantilevered from near the axis of rotation, the support arm having a driven end coupled to the drive system which pivotally reciprocates the support arm through a partial orbit around the axis of rotation;

a seat holder carried by the support arm and spaced from the driven end, wherein the seat holder has four holder segments arranged to form a square shape surrounding a center opening; and a seat supported by the seat holder, wherein the seat and seat holder are constructed to permit the seat to be selectively positioned on the seat holder in more than one optional seat facing orientation, wherein the seat can rest on the seat holder in any one of four optional seat facing orientations including a first orientation facing the support arm, a second orientation facing away from the support arm, a third orientation with the support arm positioned on the left side of the seat, and a fourth orientation with the support arm positioned on the right side of the seat.

27. A child motion device comprising:

a frame assembly configured to rest on a floor surface;

a drive system defining a generally vertical axis of rotation;

a support arm supported above the floor surface by the frame assembly and cantilevered from near the axis of rotation, the support arm having a driven end coupled to the drive system which pivotally reciprocates the support arm through a partial orbit around the axis of rotation;

a seat holder carried by the support arm and spaced from the driven end, wherein the seat holder has four holder segments arranged to form a square shape surrounding a center opening; and a seat supported by the seat holder, wherein the seat and seat holder are constructed to permit the seat to be selectively positioned on the seat holder in more than one optional seat facing orientation, wherein the seat holder has four holder segments forming a square ring, and wherein the seat can be positioned on the ring in any one of four optional seat facing orientations including a first orientation facing the support arm, a second orientation facing away from the support arm, a third orientation with the support arm positioned on the left side of the seat, and a fourth orientation with the support arm positioned on the right side of the seat.

28. A child motion device according to claim 27, wherein each of the four holder segments and the seat have latch elements arranged to allow the seat to be latched on the seat holder in any one of the four optional seat facing orientations.

* * * * *